US007370814B2

(12) United States Patent
Chih

(10) Patent No.: US 7,370,814 B2
(45) Date of Patent: May 13, 2008

(54) SPRINKLER WITH SPRINKLING FIGURES CHANGEABLE WITH SINGLE HAND

(76) Inventor: Gordon Chih, No. 33, Tien-Yang Lane, Chao-An Li, Lu-Kang Chen, Changhua Hsien (TW)

( * ) Notice: Subject to any disclaimer, the term of this patent is extended or adjusted under 35 U.S.C. 154(b) by 0 days.

(21) Appl. No.: 11/551,226

(22) Filed: Oct. 19, 2006

(65) Prior Publication Data

US 2007/0095944 A1 May 3, 2007

(30) Foreign Application Priority Data

Oct. 21, 2005 (TW) ..... 94218245 U

(51) Int. Cl.
*A62C 31/02* (2006.01)
*B05B 7/02* (2006.01)
*B05B 9/01* (2006.01)

(52) U.S. Cl. ..... 239/394; 239/391; 239/392; 239/436; 239/526

(58) Field of Classification Search ..... 239/394, 239/391, 392, 436, 526, 390, 397, 437–439, 239/442, 443, 525, 527, 538, 540, 548, DIG. 1
See application file for complete search history.

(56) References Cited

U.S. PATENT DOCUMENTS

| | | | | |
|---|---|---|---|---|
| 4,903,897 | A * | 2/1990 | Hayes | 239/394 |
| 6,595,440 | B2 * | 7/2003 | Moriarty et al. | 239/226 |
| 6,719,219 | B1 * | 4/2004 | Wang | 239/526 |
| 2005/0258274 | A1 * | 11/2005 | Wang | 239/393 |
| 2005/0274826 | A1 * | 12/2005 | Chen | 239/526 |

* cited by examiner

*Primary Examiner*—Darren Gorman
(74) *Attorney, Agent, or Firm*—Ming Chow; Sinorica, LLC

(57) ABSTRACT

A sprinkler with sprinkling figures changeable with single hand, including a main body, a sprinkling head and a driving unit. One end of the main body is formed with a water inlet, while the other end of the main body is formed with a water outlet. The sprinkling head is formed with multiple annularly arranged subchannels for discharging water. The sprinkling head is rotatably connected with front end of the main body corresponding to the water outlet.

19 Claims, 10 Drawing Sheets

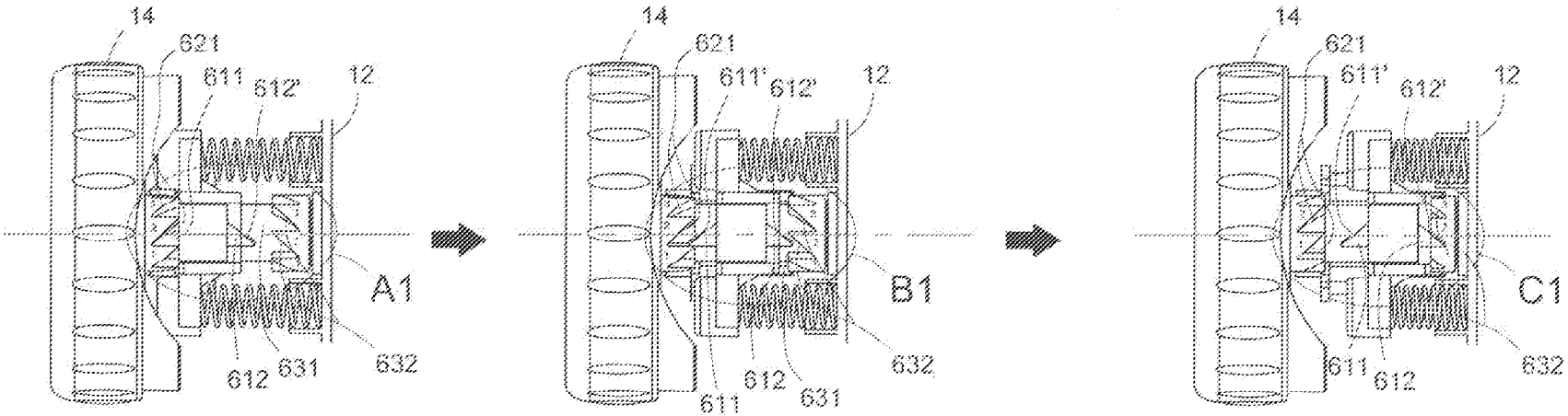
Fig. 9A
Fig. 9B
Fig. 9C
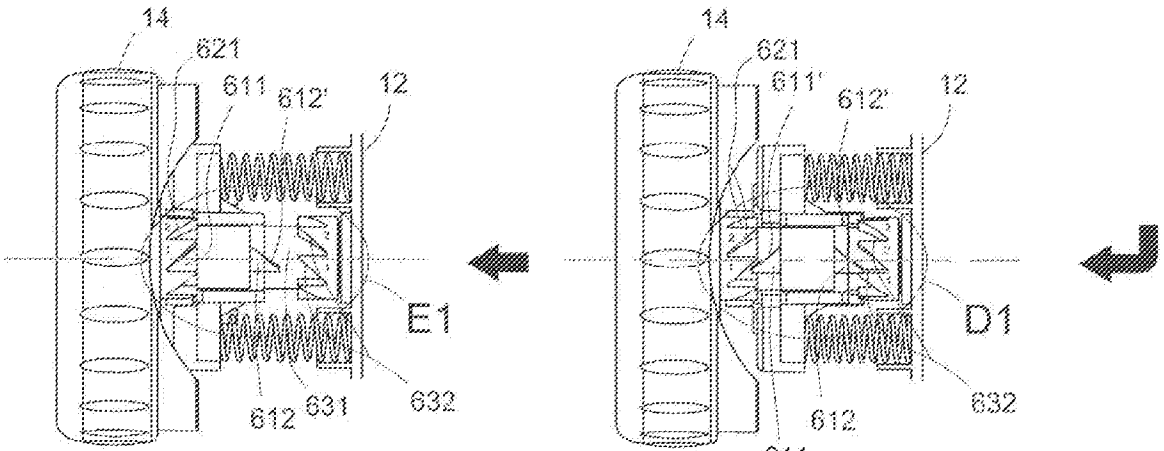
Fig. 9D
Fig. 9E

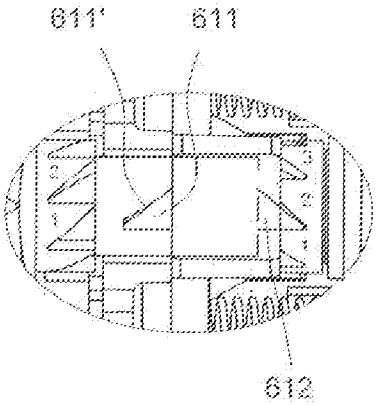
Fig. 9C-C1
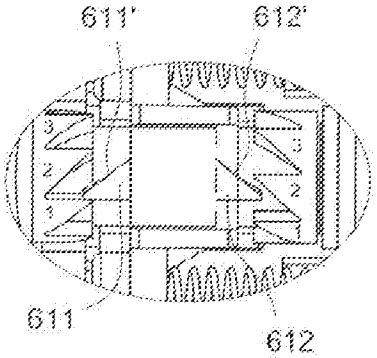
Fig. 9B-B1
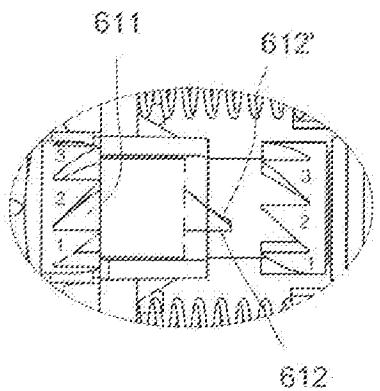
Fig. 9A-A1
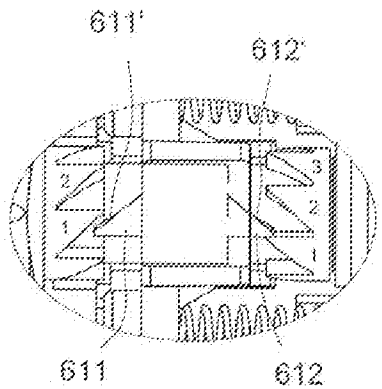
Fig. 9D-D1
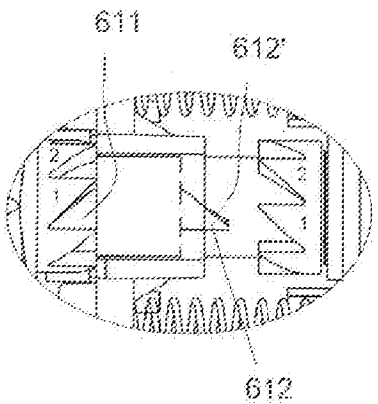
Fig. 9E-E1

SPRINKLER WITH SPRINKLING FIGURES CHANGEABLE WITH SINGLE HAND

BACKGROUND OF THE INVENTION

The present invention is related to a sprinkler with variable sprinkling figures, and more particularly to a sprinkler with sprinkling figures changeable with single hand.

FIGS. 1 and 2 show a conventional sprinkling gun capable of varying sprinkling figures. The sprinkling gun includes a main body 91 and a sprinkling head 92. One end of the main body 91 is formed with a water inlet 93, while the other end of the main body 91 is formed with a water outlet 94. The sprinkling head 92 is formed with multiple annularly arranged sprinkling openings and water ducts designed with various sprinkling figures. The ducts communicate with both faces of the sprinkling head 92. The sprinkling head 92 is rotatably connected with front end of the main body 91 corresponding to the water outlet 94. One end of each duct can be aligned with the water outlet 94 for receiving a water flow coming from the water outlet 94. When changing the sprinkling figure, a user must hold the handle of the sprinkling gun with one hand and turn the sprinkling head 92 with the other hand (as shown in FIG. 2). In other words, the user must use both hands to change the sprinkling figure. This is quite inconvenient and the hands of the user will be wetted. Furthermore, when it is desired to change the sprinkling figure, in the case that the user holds the sprinkling gun with one hand and holds a sponge or a brush with the other hand for washing an article, it is necessary for the user to drop the sponge or the brush and vacate one hand for turning the sprinkling head 92. This is also quite inconvenient.

SUMMARY OF THE INVENTION

It is therefore a primary object of the present invention to provide a sprinkler with sprinkling figures changeable with single hand. A user can readily and conveniently rotate the sprinkling head to change the sprinkling figures.

It is a further object of the present invention to provide the above sprinkler. A user can change the sprinkling figures of the sprinkler with single hand.

It is still a further object of the present invention to provide the above sprinkler. A user can easily rotate the sprinkling head to change the sprinkling figures.

According to the above objects, the sprinkler with sprinkling figures changeable with single hand of the present invention includes a main body, a sprinkling head and a driving unit. One end of the main body is formed with a water inlet, while the other end of the main body is formed with a water outlet. The sprinkling head is formed with multiple annularly arranged subchannels for discharging water. The sprinkling head is rotatably connected with front end of the main body corresponding to the water outlet. One end of any subchannel can be aligned with the water outlet. The driving unit is disposed between the main body and the sprinkling head, including a force application member and at least one driven section. The force application member is reciprocally movably positioned between the main body and the sprinkling head. The driven section is disposed between the main body and the sprinkling head. The guide slope of the force application member can slide along one of the guide slopes of the driven section to drive the driven section. The driven section further drives and rotates the sprinkling head.

The present invention can be best understood through the following description and accompanying drawings wherein:

BRIEF DESCRIPTION OF THE DRAWINGS

FIG. 9A is a top view of the first embodiment of the present invention, showing that the guide slope of the first driving section of the force application member is engaged with one of the guide slopes of the first driven section;

FIG. 9B is a top view according to FIG. 9A, showing that the force application member is moved toward the main body;

FIG. 9C is a top view according to FIG. 9A, showing that the guide slope of the second driving section of the force application member is guided and slid to engage with one of the guide slopes of the second driven section so as to rotate the sprinkling head;

FIG. 9D is a top view according to FIG. 9A, showing that the force application member is moved toward the sprinkling head;

FIG. 9E is a top view according to FIG. 9A, showing that the guide slope of the first driving section of the force application member is guided and slid to engage with one of the guide slopes of the first driven section so as to drive and rotate the sprinkling head, in which the numerals 1, 2 and 3 denote three guide slopes of the first and second driven sections;

FIG. 9A-A1 is an enlarged view of circled area of FIG. 9A;

FIG. 9B-B1 is an enlarged view of circled area of FIG. 9B;

FIG. 9C-C1 is an enlarged view of circled area of FIG. 9C;

FIG. 9D-D1 is an enlarged view of circled area of FIG. 9D;

FIG. 9E-E1 is an enlarged view of circled area of FIG. 9E;

DETAILED DESCRIPTION OF THE PREFERRED EMBODIMENTS

Figure 1:
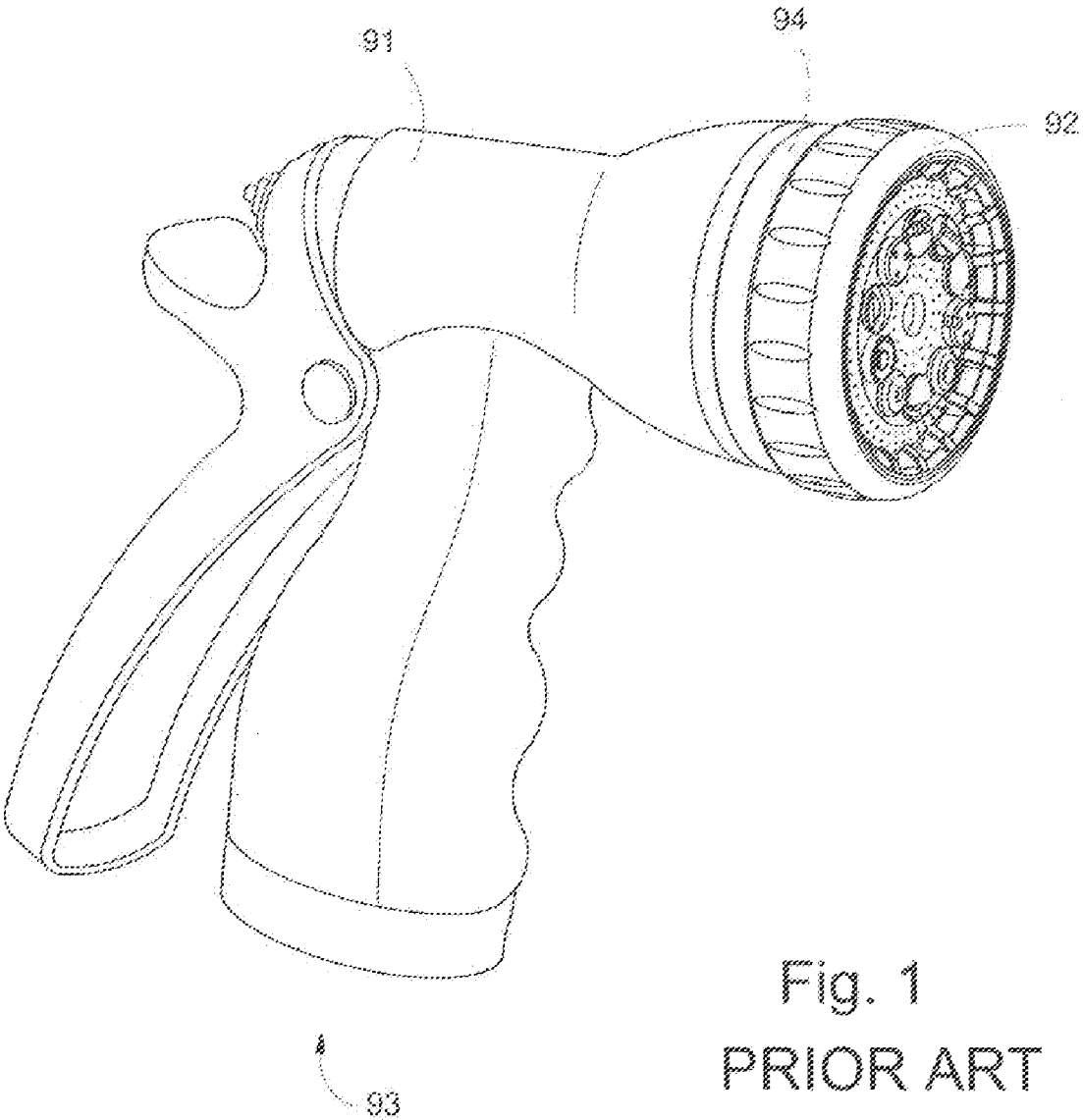
Fig. 1 PRIOR ART
FIG. 1 is a perspective view of a conventional sprinkling gun with variable sprinkling figures.

Please refer to FIGS. 3 to 10. The sprinkler of the present invention includes a main body 12, a sprinkling head 14 and a driving unit 16. The main body 12 possesses a channel inside. One end of the channel of the main body 12 is formed with a water inlet 22, while the other end of the channel of the main body 12 is formed with a water outlet 24 from which a water flow outgoes. The sprinkling head 14 possesses an outside side and an inner side oppositely. The sprinkling head 14 is formed with multiple annularly arranged subchannels 42 designed with various sprinkling figures at the outside side. The subchannels 42 communicate with two opposite sides of the sprinkling head 14. The sprinkling head 14 is rotatably connected with front end of the main body 12 corresponding to the water outlet 24. One end of each subchannel 42 can be respectively aligned with the water outlet 24 for receiving the water flow coming from the water outlet 24. The rotational axis of the sprinkling head 14 corresponds to the direction of the water flow.

The driving unit 16 is disposed between the main body 12 and the sprinkling head 14, including at least one force application member 61 and a driven section. The force application member 61 is reciprocally movably disposed between the main body 12 and the sprinkling head 14. The driven section is positioned between the main body 12 and the sprinkling head 14. The force application member 61 serves to drive the driven section to drive and one-way rotate the sprinkling head 14, whereby one end of each subchannel 42 can be aligned with the water outlet 24.

The driven section is disposed on the inner side of the sprinkling head 14, which side faces the water outlet 24. The driven section includes a first driven section 62 and a second driven section 63 spaced from each other by a certain distance. The first driven section 62 includes multiple guide slopes 621 annularly arranged on the inner side of the sprinkling head 14. The axis of the first driven section 62 coincides with the rotational axis of the sprinkling head 14. The second driven section 63 includes a stem section 631 with a certain length and multiple guide slopes 632 annularly disposed on the stem section 631. The stem section 631 is connected to the inner side of the sprinkling head 14. The axis of the second driven section 63 coincides with the rotational axis of the sprinkling head 14.

The force application member 61 is positioned between the first and second driven sections 62, 63. One end of the force application member 61 has a first driving section 611 and a second driving section 612 respectively corresponding to the first and second driven sections 62, 63. Each of the first and second driving sections 611, 612 has at least one guide slope 611', 612'. When the force application member 61 is moved, the guide slope 611' of the first driving section 611 and the guide slope 612' of the second driving section 612 respectively at different times slide along one guide slope 621 of the first driven section 62 and one guide slope 632 of the second driven section 63.

In order to describe the operation principle of the present invention more detailedly, please refer to FIGS. 9A, 9B, 9C, 9D 9E and FIGS. 9A-A1, 9B-B1, 9C-C1, 9D-D1, 9E-E1. The guide slope 611' of the first driving section 611 and the guide slope 612' of the second driving section 612 are mirror symmetrical to each other. That is, the slope relating to the rotational axis of the guide slope 611' is a plus value, while the slope relating to the rotational axis of the guide slope 612' is a minus value and the absolute values of the slopes of the guide slopes 611', 612' are equal to each other. In addition, the positions of the guide slopes 611', 612' correspond to each other. The slopes of the guide slopes 621 of the first driven section 62 and the guide slopes 632 of the second driven section 63 respectively correspond to the slope of the guide slope 611' of the first driving section 611 and the guide slope 612' of the second driving section 612. However, the positions of the guide slopes 621 of the first driven section 62 and the positions of the guide slope 632 of the second driven section 63 are not mirror symmetrical to each other. In the beginning, the guide slope 611' of the first driving section 611 abuts against one of the guide slopes 621 of the first driven section 62 as shown in FIG. 9A and 9A-A1. When the force application member 61 is moved toward the main body 12, the guide slope 612' of the second driving section 612 slides along one of the guide slopes 632 of the second driven section 63 so as to drive and rotate the sprinkling head 14 as shown in FIGS. 9C and 9C-C1. When the force application member 61 is moved toward the sprinkling head 14, the guide slope 611' of the first driving section 611 slides along one of the guide slopes 621 of the first driven section 62 so as to drive and rotate the sprinkling head 14 as shown in FIGS. 9E and 9E-E1. Therefore, the sprinkling figures can be varied.

Alternatively, the guide slope 611' of the first driving section 611 can have a position not corresponding to the position of the guide slope 612' of the second driving section 612. This can also achieve the same effect.

Still alternatively, the absolute values of the slopes of the guide slope 611', 612' of the first and second driving sections 611, 612 can be unequal to each other. This can also achieve the same effect.

Figure 2:
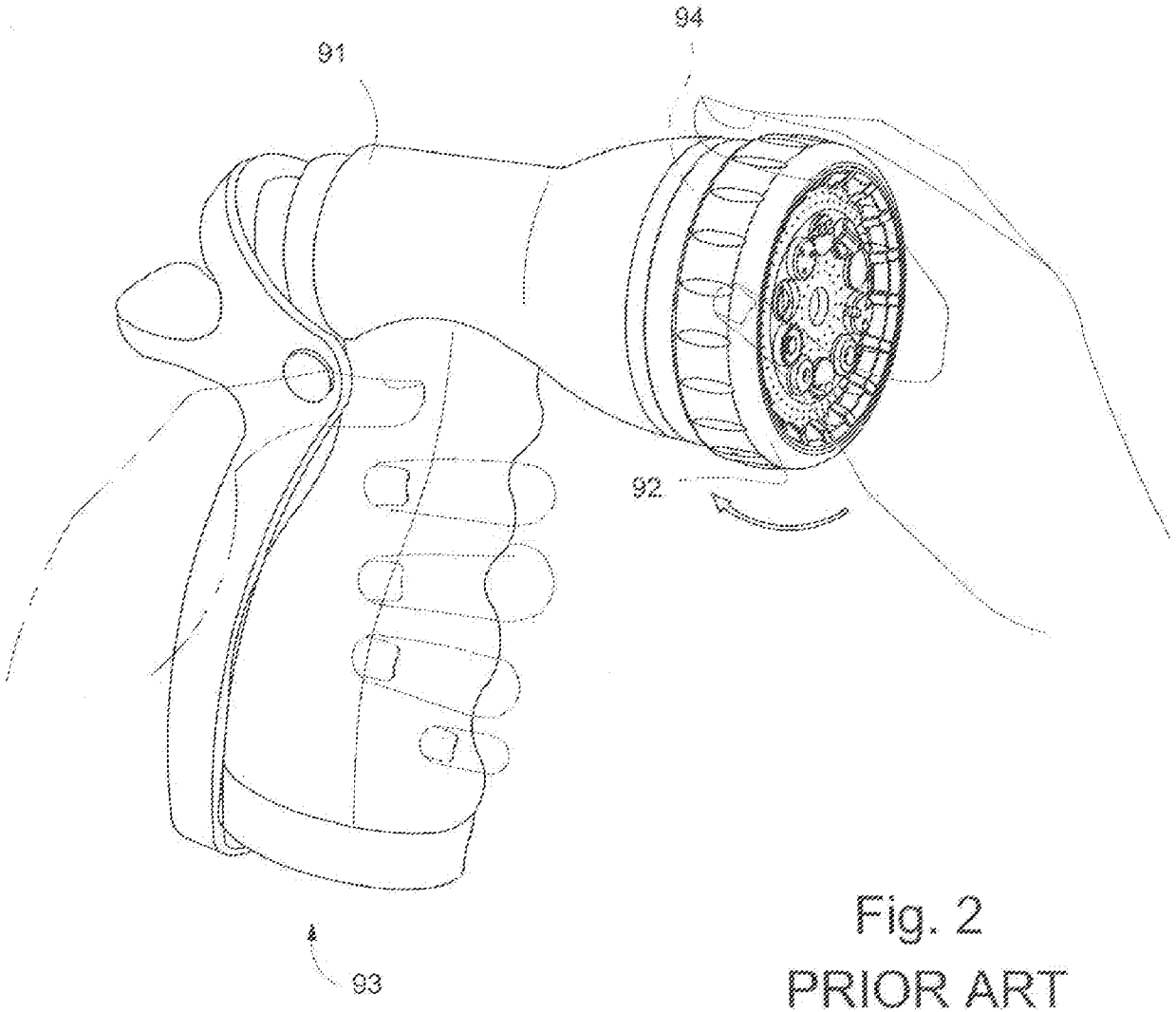
Fig. 2 PRIOR ART
FIG. 2 is a perspective view of the conventional sprinkling gun, showing the use thereof.
Figure 3:
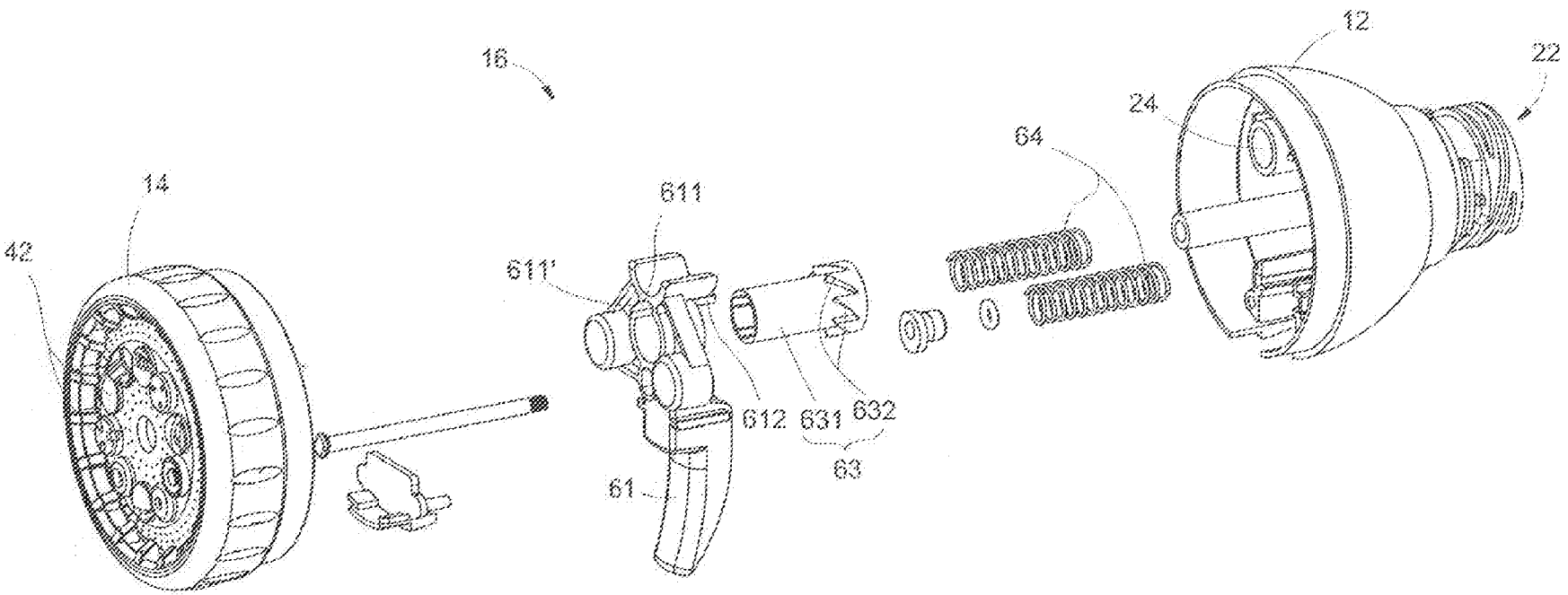
FIG. 3 is a perspective exploded view of a first embodiment of the present invention.
Figure 4:
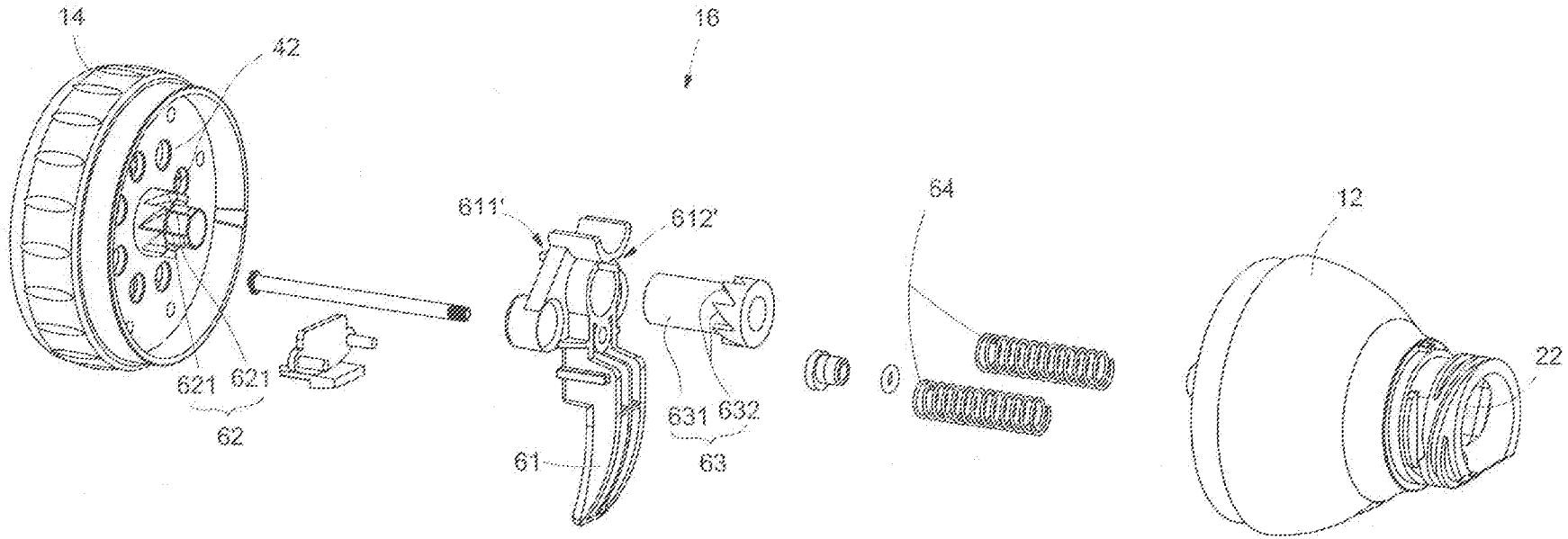
FIG. 4 is a perspective exploded view of the first embodiment of the present invention, seen in another direction.
Figure 5:
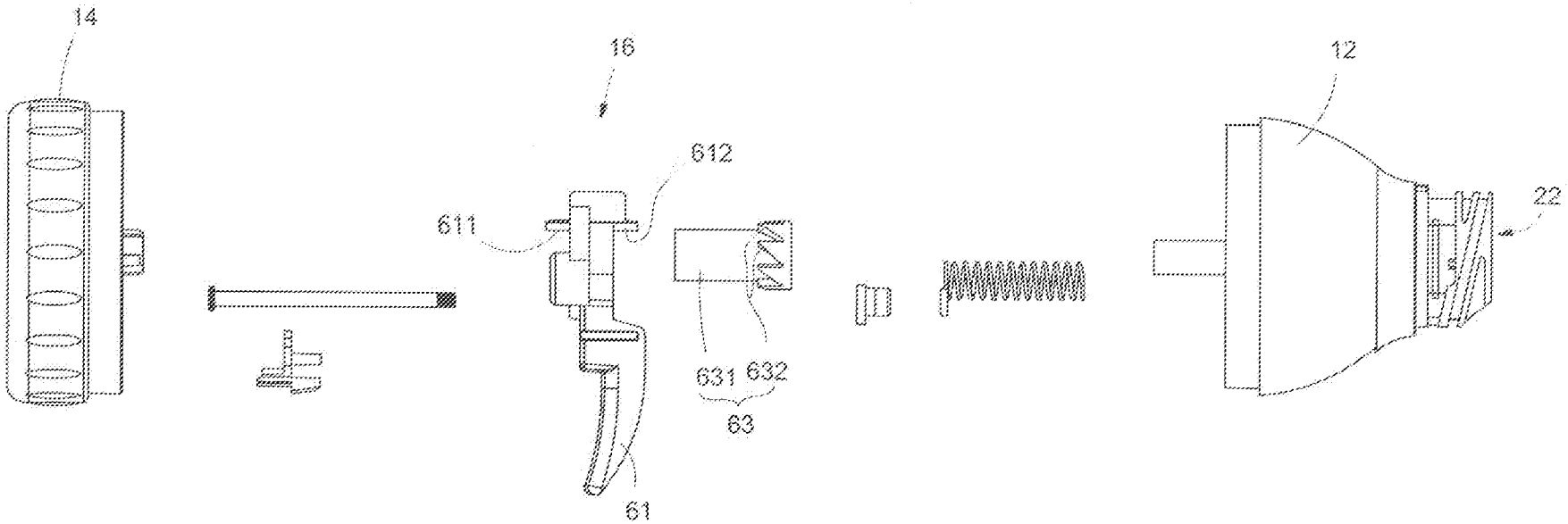
FIG. 5 is a side view according to FIG. 3.
Figure 8:
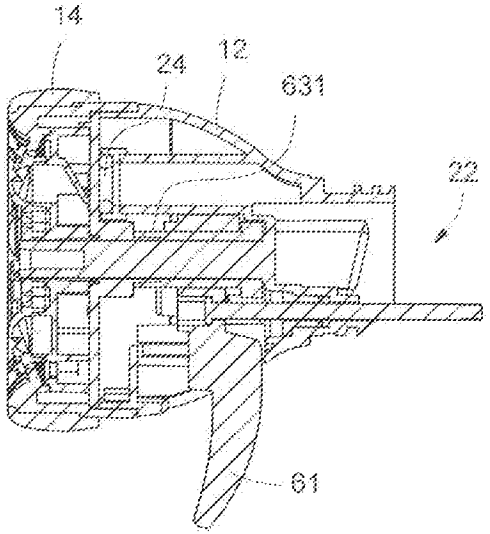
FIG. 8 is a sectional view taken along line 1-1 of FIG. 7.
Figure 7:
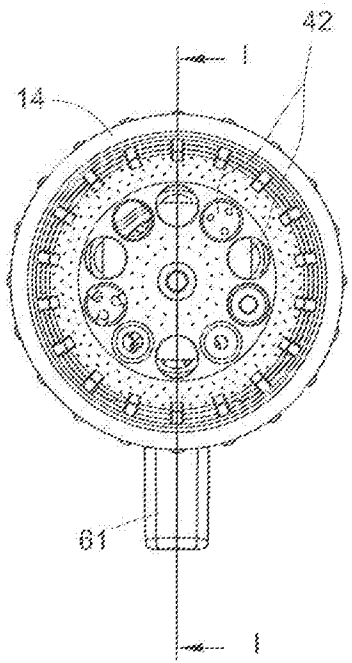
FIG. 7 is a front view of the first embodiment of the present invention.
Figure 6:
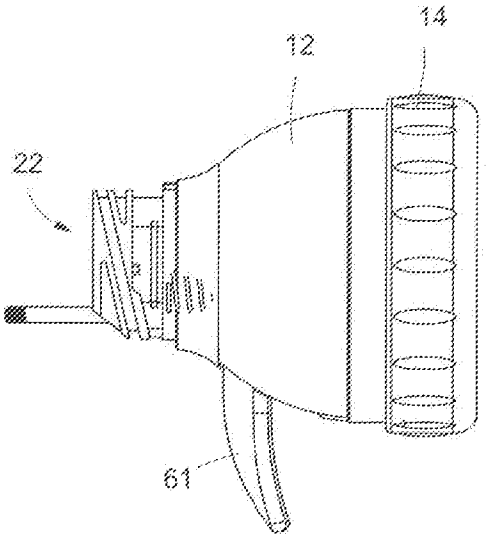
FIG. 6 is a side assembled view of the first embodiment of the present invention.
Figure 10:
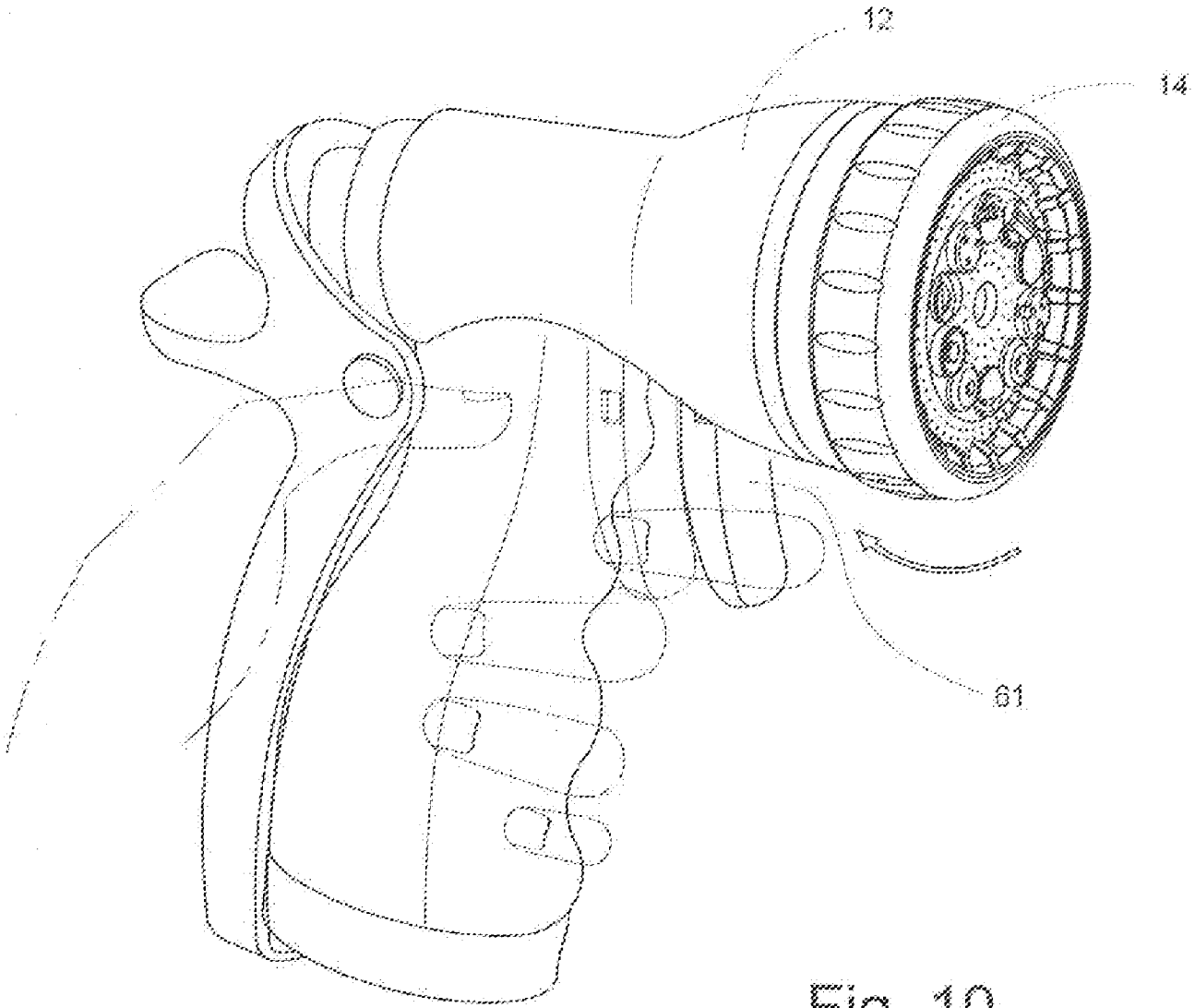
FIG. 10 is a perspective view of the first embodiment of the present invention, showing that the sprinkling head is turned to change the sprinkling figure.

According to the above arrangement, the sprinkler with sprinkling figures changeable with single hand of the present invention has the following advantages:

1. The force application member 61 is positioned between the main body 12 and the sprinkling head 14. When it is desired to change the sprinkling figures, a user only needs to pull the force application member 61 with one finger to readily and conveniently turn the sprinkling head 14 and change the sprinkling figures.
2. By means of the sliding and guiding between the guide slopes, the user can easily shift the force application member 61 to rotate the sprinkling head 14 for changing the sprinkling figures.

In the above structure, the first driven section 62 is composed of multiple saw teeth. The guide slopes 632 of the second driven section 63 are multiple saw teeth. The first driving section 611 is a saw tooth. The second driving section 612 is also a saw tooth. The saw teeth are engaged with each other to better locate the sprinkling head 14.

After the sprinkling head 14 is driven to a true position by the force application member 61, the saw tooth of the force application member 61 is not engaged with any other saw tooth. At this time, the sprinkling head 14 is located by a locating pin disposed between the sprinkling head 14 and the main body 12. This pertains to prior art and thus will not be further described hereinafter.

In the above structure, the stem section 631 is fitted through the force application member 61, whereby the force application member 61 can reciprocally move along the stem section 631.

At least one resilient member 64 such as a coiled spring is disposed between the force application member 61 and the main body 12 for restoring and pressing the force application member 61 against the sprinkling head 14. Accordingly, the saw tooth of the force application member 61 can truly engage with the saw tooth of the sprinkling head to locate the sprinkling head 14.

Figure 11:
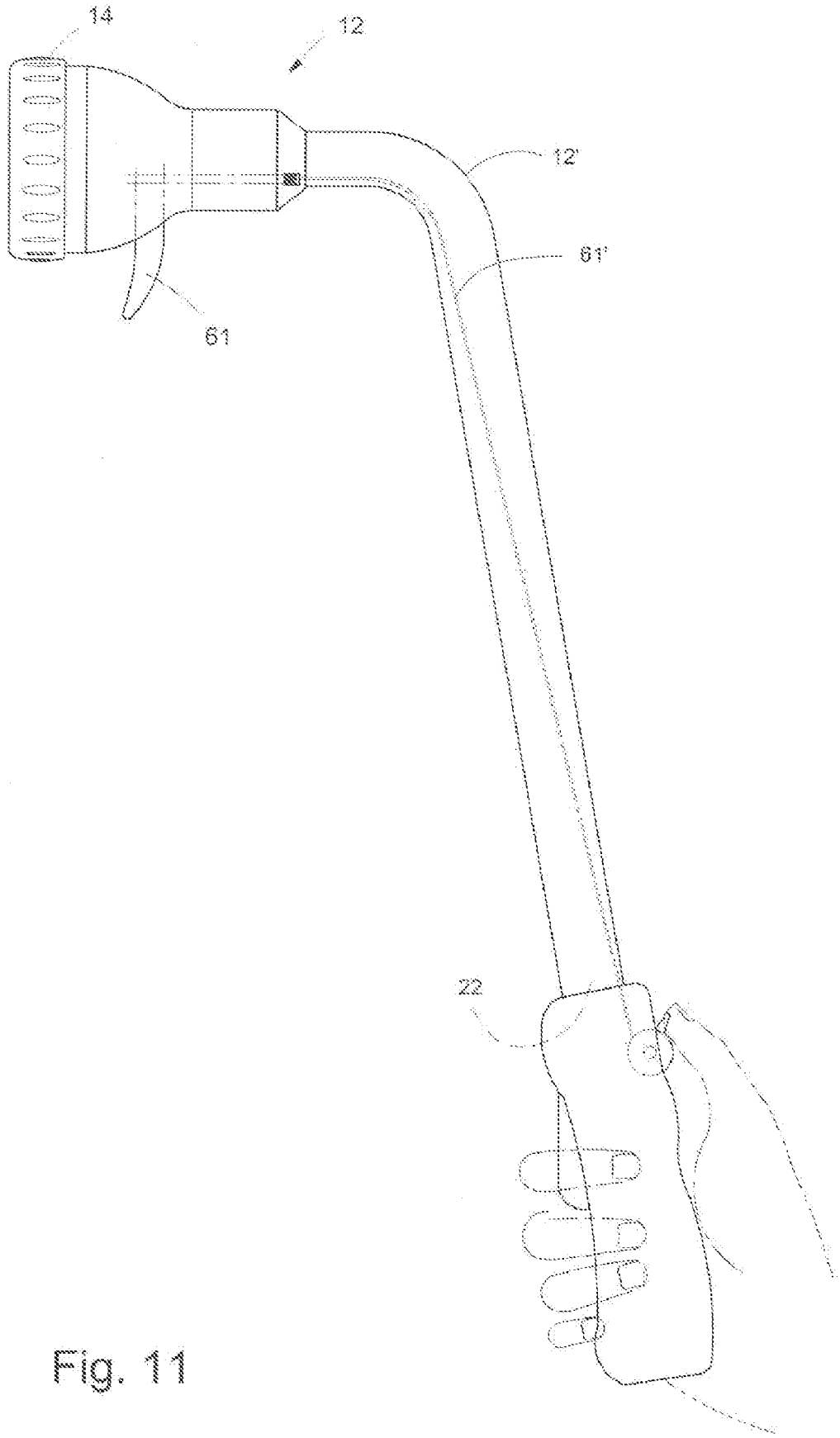
FIG. 11 is a side view of a second embodiment of the present invention.

FIG. 11 shows a second embodiment of the present invention, in which a tube body 12' extends from the water inlet 22 of the main body 12 or is connected to the water inlet 22 to form an elongated sprinkling gun. The force application member 61 includes a steel cord 61' with a certain length or a rod body. One end of the steel cord 61' is connected to a middle section of the force application member 61. The other end of the steel cord 61' extends along the tube body 12' to a rear end of the tube body 12' and is connected with a handle disposed at the rear end of the tube body 12'. A user can hold the handle with one hand and pull the steel cord 61' or the rod body with one finger to remotely control and one-way rotate the sprinkling head 14.

The above embodiments are only used to illustrate the present invention, not intended to limit the scope thereof. Many modifications of the above embodiments can be made without departing from the spirit of the present invention.

What is claimed is:

1. A sprinkler with sprinkling figures changeable with single hand, comprising:

a main body possessing a channel inside, one end of the channel of the main body being formed with a water inlet, while the other end of the channel of the main body being formed with a water outlet from which a water flow outgoes;

a sprinkling head possessing an outside side and an inner side oppositely, the sprinkling head being formed with multiple annularly arranged subchannels designed with various sprinkling figures at the outside side, the subchannels communicating with two opposite sides of the sprinkling head, the sprinkling head being rotatably connected with one end of the main body corresponding to the water outlet, whereby one end of each subchannel is in alignment with the water outlet for receiving the water flow coming from the water outlet, a rotational axis of the sprinkling head corresponding to a direction of the water flow;

a driving unit disposed between the main body and the sprinkling head, the driving unit including at least one force application member and a driven section, the force application member being reciprocally movably disposed between the main body and the sprinkling head, the driven section being positioned between the main body and the sprinkling head, the force application member serving to drive the driven section to drive and rotate the sprinkling head; and the driven section is disposed on the inner side of the sprinkling head, which side faces the water outlet, the driven section including a first driven section and a second driven section, the force application member being disposed between the first and second driven sections, one end of the force application member having a first driving section and a second driving section, the first driven section including multiple guide slopes annularly arranged on the inner side of the sprinkling head, an axis of the first driven section coinciding with the rotational axis of the sprinkling head, the second driven section including a stem section and multiple guide slopes annularly disposed on the stem section, the stem section being connected to the inner side of the sprinkling head, an axis of the second driven section coinciding with the rotational axis of the sprinkling head, the first and second driving sections respectively corresponding to the first and second driven sections, each of the first and second driving sections having at least one guide slope, whereby when the force application member is moved, the guide slope of the first driving section and the guide slope of the second driving section respectively at different times slide along one guide slope of the first driven section and one guide slope of the second driven section.

2. The sprinkler with sprinkling figures changeable with single hand as claimed in claim 1, wherein the stem section is fitted through the force application member, whereby the force application member reciprocally moves along the stem section, the slope relating to the rotational axis of the guide slope of the first driving section being a plus value, while the slope relating to the rotational axis of the guide slope of the second driving section being a minus value, the slopes of the guide slopes of the first driven section and the slopes of the guide slopes of the second driven section respectively corresponding to the slope of the guide slope of the first driving section and the slope of the guide slope of the second driving section, each position of the guide slope of the first driven section being not mirror-symmetrical to each position of the guide slope of the second driven section.

3. The sprinkler with sprinkling figures changeable with single hand as claimed in claim 2, wherein a position of the guide slope of the first driving section corresponds to a position of the guide slope of the second driving section.

4. The sprinkler with sprinkling figures changeable with single hand as claimed in claim 2, wherein a position of the guide slope of the first driving section does not correspond to a position of the guide slope of the second driving section.

5. The sprinkler with sprinkling figures changeable with single hand as claimed in claim 3, wherein an absolute value of the slope of the guide slope of the first driving section is equal to an absolute value of the slope of the guide slope of the second driving section.

6. The sprinkler with sprinkling figures changeable with single hand as claimed in claim 4, wherein an absolute value of the slope of the guide slope of the first driving section is unequal to an absolute value of the slope of the guide slope of the second driving section.

7. The sprinkler with sprinkling figures changeable with single hand as claimed in claim 1, wherein the first driven section is composed of multiple saw teeth and the guide slopes of the second driven section are multiple saw teeth, the first driving section being a saw tooth, the second driving section being also a saw tooth.

8. The sprinkler with sprinkling figures changeable with single hand as claimed in claim 2, wherein the first driven section is composed of multiple saw teeth and the guide slopes of the second driven section are multiple saw teeth, the first driving section being a saw tooth, the second driving section being also a saw tooth.

9. The sprinkler with sprinkling figures changeable with single hand as claimed in claim 3, wherein the first driven section is composed of multiple saw teeth and the guide slopes of the second driven section are multiple saw teeth, the first driving section being a saw tooth, the second driving section being also a saw tooth.

10. The sprinkler with sprinkling figures changeable with single hand as claimed in claim 4, wherein the first driven section is composed of multiple saw teeth and the guide slopes of the second driven section are multiple saw teeth, the first driving section being a saw tooth, the second driving section being also a saw tooth.

11. The sprinkler with sprinkling figures changeable with single hand as claimed in claim 5, wherein the first driven section is composed of multiple saw teeth and the guide slopes of the second driven section are multiple saw teeth, the first driving section being a saw tooth, the second driving section being also a saw tooth.

12. The sprinkler with sprinkling figures changeable with single hand as claimed in claim 6, wherein the first driven section is composed of multiple saw teeth and the guide slopes of the second driven section are multiple saw teeth, the first driving section being a saw tooth, the second driving section being also a saw tooth.

13. The sprinkler with sprinkling figures changeable with single hand as claimed in claim 1, further comprising at least one resilient member disposed between the force application member and the main body for restoring and pressing the force application member against the sprinkling head.

14. The sprinkler with sprinkling figures changeable with single hand as claimed in claim 1, further comprising at least one resilient member disposed between the force application member and the main body for restoring and pressing the force application member against the sprinkling head.

15. The sprinkler with sprinkling figures changeable with single hand as claimed in claim 2, further comprising at least one resilient member disposed between the force application member and the main body for restoring and pressing the force application member against the sprinkling head.

16. The sprinkler with sprinkling figures changeable with single hand as claimed in claim 3, further comprising at least one resilient member disposed between the force application member and the main body for restoring and pressing the force application member against the sprinkling head.

17. The sprinkler with sprinkling figures changeable with single hand as claimed in claim 4, further comprising at least one resilient member disposed between the force application member and the main body for restoring and pressing the force application member against the sprinkling head.

18. The sprinkler with sprinkling figures changeable with single hand as claimed in claim 5, further comprising at least one resilient member disposed between the force application member and the main body for restoring and pressing the force application member against the sprinkling head.

19. The sprinkler with sprinkling figures changeable with single hand as claimed in claim 6, further comprising at least one resilient member disposed between the force application member and the main body for restoring and pressing the force application member against the sprinkling head.

* * * * *